US008317310B2

(12) United States Patent
Yang et al.

(10) Patent No.: US 8,317,310 B2
(45) Date of Patent: Nov. 27, 2012

(54) INK-JET HEAD

(75) Inventors: Ju-Hwan Yang, Suwon-si (KR); Jae-Woo Joung, Suwon-si (KR); Young-Seuck Yoo, Seoul (KR); Boum-Seock Kim, Suwon-si (KR)

(73) Assignee: Samsung Electro-Mechanics Co., Ltd., Gyunggi-Do (KR)

( * ) Notice: Subject to any disclaimer, the term of this patent is extended or adjusted under 35 U.S.C. 154(b) by 514 days.

(21) Appl. No.: 12/499,597

(22) Filed: Jul. 8, 2009

(65) Prior Publication Data

US 2010/0182388 A1 Jul. 22, 2010

(30) Foreign Application Priority Data

Jan. 21, 2009 (KR) ..... 10-2009-0005115

(51) Int. Cl.
*B41J 2/17* (2006.01)

(52) U.S. Cl. ..... 347/94; 347/1; 347/2; 347/68; 347/69; 347/70; 347/71; 347/72; 347/93

(58) Field of Classification Search ..... 347/1–2, 347/68–72, 93–94
See application file for complete search history.

(56) References Cited

U.S. PATENT DOCUMENTS

2005/0285915 A1* 12/2005 Shimizu ..... 347/85
2008/0007598 A1* 1/2008 Hong et al. ..... 347/68
2008/0043077 A1* 2/2008 Hong et al. ..... 347/92
2008/0074474 A1* 3/2008 Yoo et al. ..... 347/70
2008/0129799 A1* 6/2008 Lee et al. ..... 347/71

FOREIGN PATENT DOCUMENTS

JP 2002-361859 12/2002
JP 10-0754392 B1 8/2007
KR 10-2005-0087642 A 8/2005

OTHER PUBLICATIONS

Korean Office Action, with English Translation, issued in Korean Patent Application No. 10-2009-005115, dated Jan. 14, 2011.
Japanese Office Action, w/ partial English translation thereof, issued in Japanese Patent Application No. JP 2009-172390 dated Apr. 19, 2011.
Japanese Office Action, w/ partial English translation thereof, issued in Japanese Patent Application No. JP 2009-172390 dated May 8, 2012.

* cited by examiner

*Primary Examiner* — Ryan Lepisto
*Assistant Examiner* — Guy Anderson
(74) *Attorney, Agent, or Firm* — McDermott Will & Emery LLP

(57) ABSTRACT

An ink-jet head is disclosed. The ink-jet head can include: a chamber for holding ink, an actuator coupled to one side of the chamber to provide pressure to the chamber, a damper portion connected with the other side of the chamber, an accelerator portion extending from a lateral surface of the damper portion, and a nozzle formed at an end of the accelerator portion. Certain embodiments of the invention can be used to increase the speed at which ink is ejected and improve the straightness of the ejection path.

4 Claims, 9 Drawing Sheets

INK-JET HEAD

CROSS-REFERENCE TO RELATED APPLICATIONS

This application claims the benefit of Korean Patent Application No. 10-2009-0005115, filed with the Korean Intellectual Property Office on Jan. 21, 2009, the disclosure of which is incorporated herein by reference in its entirety.

BACKGROUND

1. Technical Field

The present invention relates to an ink-jet head.

2. Description of the Related Art

The application of ink-jet technology has expanded beyond the field of the graphics industry, which is for making prints on paper and fabric, etc., to the field of manufacturing, for example, printed circuit boards and electronic parts such as LCD panels, etc. Accordingly, the ink-jet head is required to provide higher performance in modern applications.

An ink-jet can be composed of a chamber for holding the ink, an actuator coupled to one side of the chamber, and a nozzle coupled to the other side of the chamber. When the actuator provides pressure on the side of the chamber, the ink stored inside the chamber may be moved by the pressure through the accelerating section at the other side of the chamber and to the nozzle, where the ink may finally be ejected out of the ink-jet head.

In this context, of an expanded range of applications for the ink-jet head and increased demands for improved performance, two factors have been recognized as important performance criteria for the ink-jet head, namely the ejection speed and the straightness of the ink ejected.

However, with the ink-jet head trending towards greater densities and smaller sizes, there is a limit to providing high ejection speed and straight ejection paths only by improving the performance of the actuators.

SUMMARY

An aspect of the invention provides an ink-jet head having improved ejection properties.

Another aspect of the invention provides an ink-jet head that includes: a chamber for holding ink, an actuator coupled to one side of the chamber to provide pressure to the chamber, a damper portion connected with the other side of the chamber, an accelerator portion extending from a lateral surface of the damper portion, and a nozzle formed at an end of the accelerator portion.

In certain embodiments, the accelerator portion can extend from a lateral surface at an end of the damper portion, and an opposite lateral surface of the damper portion can be inclined, so that the flow resistance of the ink may be reduced. The cross-section of the accelerator portion can be smaller than that of the damper portion.

Additional aspects and advantages of the present invention will be set forth in part in the description which follows, and in part will be obvious from the description, or may be learned by practice of the invention.

DETAILED DESCRIPTION

Figure 1:
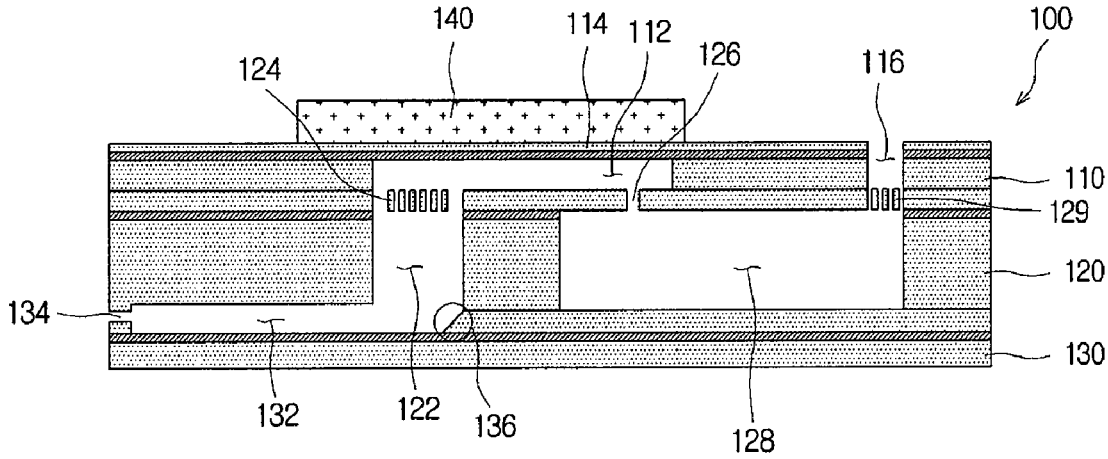
FIG. 1 is a cross-sectional view of an ink-jet head according to an embodiment of the invention.

The ink-jet head according to certain embodiments of the invention will be described below in more detail with reference to the accompanying drawings. Those components that are the same or are in correspondence are rendered the same reference numeral regardless of the figure number, and redundant descriptions are omitted.

FIG. 1 is a cross-sectional view of an ink-jet head 100 according to an embodiment of the invention. As in the example shown in FIG. 1, an ink-jet head 100 according to an embodiment of the invention can include a chamber 112 holding an ink, an actuator 140 coupled to one side of the chamber 112 to provide pressure to the chamber 112, a damper portion 122 connected with the other side of the chamber 112, an accelerator portion 132 extending from a lateral surface of the damper portion 122, and a nozzle 134 formed at an end of the accelerator portion 132. The ink-jet head 100 can be used to increase ink-ejection speed and improve the straightness of the ejection.

The chamber 112 can be formed with a space for holding ink inside the ink-jet head 100. The chamber 112 can be connected by the restrictor 126 to the reservoir 128. The reservoir 128 is a part for storing ink, which can be supplied through an inlet 116 from outside the ink-jet head 100.

A filter 129 can be positioned between the inlet 116 and the reservoir 128, to prevent the inflow of foreign substances into the ink-jet head 100. The restrictor 126 can be a part between the chamber 112 and the reservoir 128 where the cross-section changes. The restrictor 126 may supply the ink in the reservoir 128 to the chamber 112 while preventing backflow.

A membrane 114 can be formed on one side of the chamber 112, with the actuator 140 coupled onto the membrane 114. The actuator 140 can include a piezoelectric element, for example, and can transfer the deformations of the piezoelectric element to the chamber 110 by way of the membrane 111. In this way, the actuator 140 can provide the pressure needed to eject the ink stored in the chamber 112.

The damper portion 122 can be connected to the other side of the chamber 112, i.e. the side of the chamber opposite the actuator 140. The damper portion 122 can be positioned between the nozzle 134 and the chamber 112, and can extend in the direction of the actuator 140 applying pressure from the other side of the chamber 112.

The damper portion 122 can serve as a buffer to the pressure applied by the actuator 140, as the pressure applied to the chamber 112 may not directly affect the ink being ejected. A filter 124 can be positioned between the damper portion 122 and the chamber 112, to prevent the flow of foreign substances towards the nozzle 134.

The accelerator portion 132 can extend from a lateral surface of the damper portion 122. The damper portion 122 can extend longitudinally in relation to the ink-jet head 100, and the accelerator portion 132 can extend laterally in relation to the ink-jet head 100 from a lateral wall of the damper portion 122. For example, the accelerator portion 132 can be formed perpendicularly to the direction of the actuator 140 applying pressure to the chamber 112, extending along a lateral direction of the ink-jet head 100.

Thus, the accelerator portion 132 makes it possible to increase the section through which the ink may be accelerated and thus increase the ejection speed of the ink-jet head 100, without increasing the overall thickness of the ink-jet head 100. In other words, the ejection speed of the ink-jet head 100 can be increased by improving the structure of the ink-jet head 100, without having to improve the performance of the actuator 140.

Also, the accelerator portion 132 can extend along a linear path towards a lateral surface of the ink-jet head 100. This arrangement can improve the straightness of the ink during ejection. As such, certain embodiments of the invention can be used to improve frequency characteristics by increasing the printing speed of the ink-jet head 100 and to improve the straightness of ink ejection by extending the section that guides the flow of the ejected ink.

The accelerator portion 132 can be made with a cross-section that is smaller than the cross-section of the damper portion 122. As the ink held in the damper portion 122 flows through the accelerator portion 132, which has a smaller cross-section than does the damper portion 122, the pressure transferred to the damper portion 122 from the actuator 140 may be converged towards the nozzle 134 with greater efficiency.

The accelerator portion 132 can be coupled to the end of the damper portion 122, while a part of the damper portion 122 opposite the accelerator portion 132 can be inclined (hereinafter referred to as the "inclined portion 136"), to reduce flow resistance at the part where the damper portion 122 and the accelerator portion 132 are connected perpendicularly.

The ink-jet head 100 can be oriented as in FIG. 1 to eject ink towards a lateral direction. However, it is obvious that the ink-jet head 100 can also be rotated by 90 degrees in a counter-clockwise direction, to eject ink in the direction of gravity.

A description will now be provided on a possible method of manufacturing the ink-jet head 100.

Figure 2:
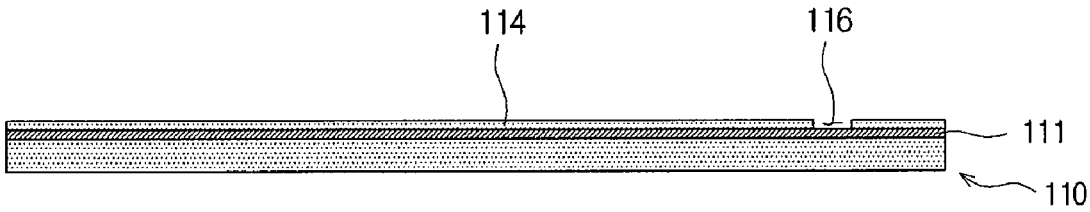
FIG. 2 and FIG. 3 are cross-sectional views representing an operation of processing a first plate for an ink-jet head according to an embodiment of the invention.
Figure 3:
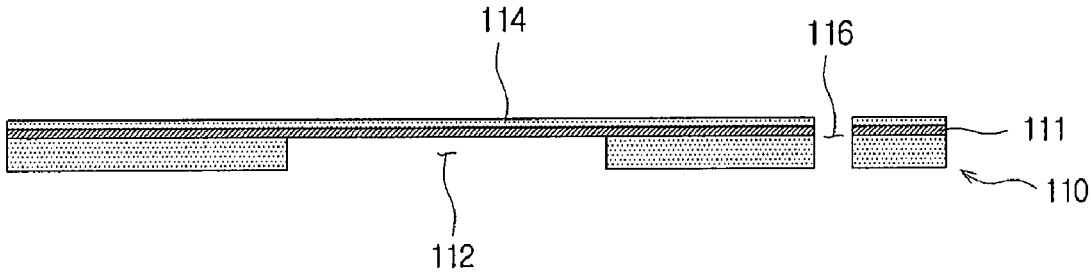

FIGS. 2 and 3 are cross-sectional views representing an operation of processing a first plate 110 for an ink-jet head 100 according to an embodiment of the invention. As in the example shown in FIG. 2, a first plate 110, composed of a silicon substrate and an interposed oxide layer 111 ($SiO_2$), can be etched in one surface to form a part of the inlet 116. Here, the oxide layer 111 can serve as an etching stop.

Next, as in the example shown in FIG. 3, the opposite surface of the first plate 110 can be etched to form the chamber 112 and the remaining part of the inlet 116. The etching operation can include etching parts of the silicon substrate of the first plate 110, to form the inlet 116 and the chamber 112, and etching the oxide layer 111 to form the inlet 116.

The upper part of the chamber 112 can be used as the membrane 114. Therefore, the inlet 116, chamber 112, and membrane 114 can be formed in the first plate 110.

Figure 4:
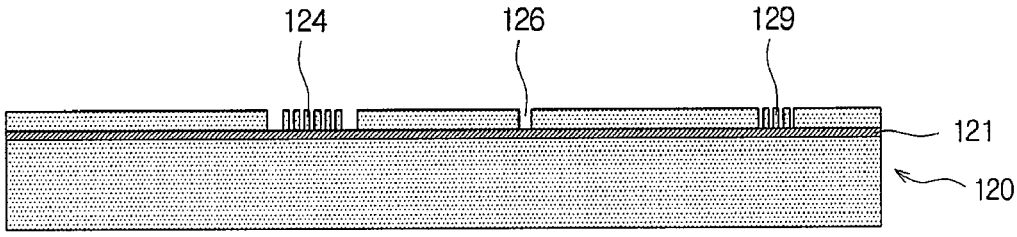
FIG. 4, FIG. 5, and FIG. 6 are cross-sectional views representing an operation of processing a second plate for an ink-jet head according to an embodiment of the invention.
Figure 5:
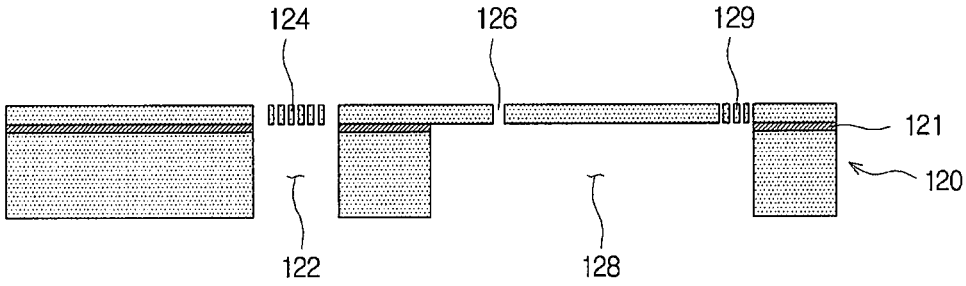
Figure 6:
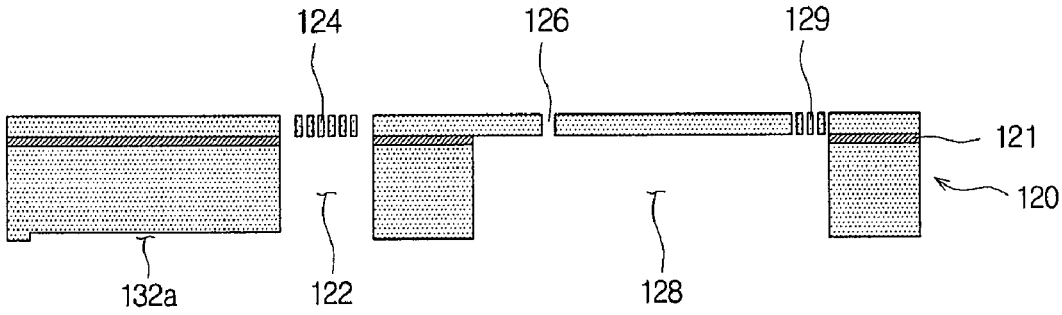

FIG. 4 through FIG. 6 are cross-sectional views representing an operation of processing a second plate 120 for an ink-jet head 100 according to an embodiment of the invention. The second plate 120 can be a silicon substrate having an interposed oxide layer 121.

First, as in the example shown in FIG. 4, one surface of the second plate 120 can be etched to form the filters 124 and 129 and the restrictor 126. Then, as in the example shown in FIG. 5, the other surface of the second plate 120 can be etched to form the damper portion 122 and the reservoir 128. Next, as in the example shown in FIG. 6, the other surface of the second plate 120 can be etched to form a part 132*a* of the accelerator portion.

Figure 7:
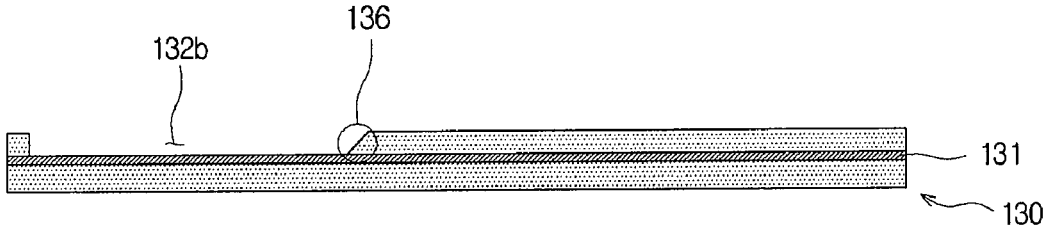
FIG. 7 and FIG. 8 are cross-sectional views representing an operation of processing a third plate for an ink-jet head according to an embodiment of the invention.
Figure 8:
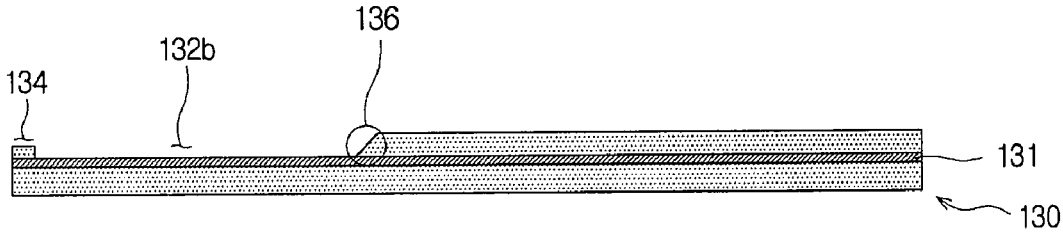

FIGS. 7 and 8 are cross-sectional views representing an operation of processing a third plate 130 for an ink-jet head 100 according to an embodiment of the invention. As in the example shown in FIG. 7, the third plate 130 can also be a silicon substrate having an interposed oxide layer 131.

By etching one surface of the third plate 130, the remaining part of the accelerator portion 132 and the inclined portion 136 can be formed. The inclined portion 136 can be formed using, for example, wet etching. Afterwards, the end of the third plate 130 can be etched, to decrease the thickness and form the nozzle 134.

Figure 9:
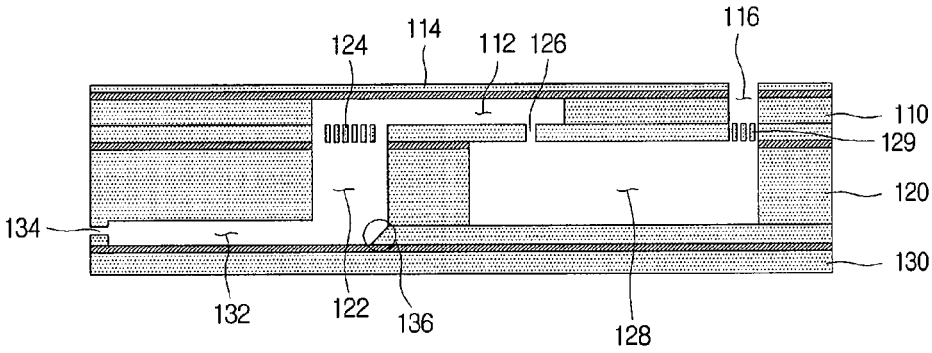
FIG. 9 is a cross-sectional view representing an operation of attaching the first through third plates for an ink-jet head according to an embodiment of the invention.

FIG. 9 is a cross-sectional view representing an operation of attaching the first through third plates 110, 120, and 130 for an ink-jet head 100 according to an embodiment of the invention. As in the example shown in FIG. 9, the first, second, and third plates 110, 120, and 130 can be stacked together to form the body of the ink-jet head 100. By attaching the actuator 140 to this configuration, an ink-jet head 100 can be formed such as that illustrated in FIG. 1.

As set forth above, certain embodiments of the invention can be used to increase the speed at which ink is ejected, as well as to improve the straightness of the ejection path.

While the spirit of the invention has been described in detail with reference to particular embodiments, the embodiments are for illustrative purposes only and do not limit the invention. It is to be appreciated that those skilled in the art can change or modify the embodiments without departing from the scope and spirit of the invention.

What is claimed is:

1. An ink-jet head, comprising:

a chamber for holding ink;

an actuator coupled to an upper side of the chamber configured to provide pressure to the chamber;

a damper portion connected with a bottom side of the chamber;

an accelerator portion extending from a lateral surface of the damper portion; and a nozzle formed at an end of the accelerator portion and on a lateral surface of ink-jet head, wherein the accelerator portion extends laterally from the lateral surface of the damper portion to the lateral surface of the ink-jet head.

2. The ink-jet head of claim 1, wherein the accelerator portion extends from the lateral surface of the damper portion at an end of the damper portion.

3. The ink-jet head of claim 2, wherein an opposite lateral surface of the damper portion is inclined to reduce a flow resistance of the ink.

4. The ink-jet head of claim 1, wherein the accelerator portion has a cross-section smaller than a cross-section of the damper portion.

* * * * *